US007413415B2

(12) United States Patent
Buzzi

(10) Patent No.: US 7,413,415 B2
(45) Date of Patent: Aug. 19, 2008

(54) RECIPROCATING ELECTROMAGNETIC MICRO-PUMP, PARTICULARLY FOR SMALL ELECTRICAL APPLIANCES

(75) Inventor: Bruno Buzzi, Turin (IT)

(73) Assignee: Ceme S.P.A. (IT)

( * ) Notice: Subject to any disclaimer, the term of this patent is extended or adjusted under 35 U.S.C. 154(b) by 774 days.

(21) Appl. No.: 10/776,165

(22) Filed: Feb. 12, 2004

(65) Prior Publication Data

US 2004/0241017 A1 Dec. 2, 2004

(30) Foreign Application Priority Data

May 30, 2003 (IT) ..... TO2003A0400

(51) Int. Cl.
*F04B 49/08* (2006.01)
*F04B 49/24* (2006.01)
*F04B 17/04* (2006.01)

(52) U.S. Cl. ..... 417/283; 417/296; 417/417

(58) Field of Classification Search ..... 417/283, 417/296, 417, 545, 547
See application file for complete search history.

(56) References Cited

U.S. PATENT DOCUMENTS 4,169,695 A * 10/1979 Masuda et al. ..... 417/417
4,934,907 A * 6/1990 Kroner ..... 417/417
6,942,470 B1 * 9/2005 Versini ..... 417/417

FOREIGN PATENT DOCUMENTS

| | | | |
|---|---|---|---|
| DE | 19 14 879 | A1 | 10/1970 |
| DE | 43 28 621 | A1 | 3/1995 |
| EP | 1 205 663 | A1 | 5/2002 |
| WO | WO 03/027454 | A1 | 4/2003 |

* cited by examiner

*Primary Examiner*—Charles G Freay
(74) *Attorney, Agent, or Firm*—Nixon & Vanderhye PC

(57) ABSTRACT

Reciprocating electromagnetic micro-pump, particularly for small electrical appliances, whose pumping chamber is defined by a tubular element, movable axially, against the action of a contrasting spring, between an advanced position of normal operation of the pump and a retracted position in which the outlet fitting of the pump is placed in communication with the cavity of the hollow body within which is movable in reciprocating fashion the core bearing the piston and which in turn communicates with the inlet fitting of the pump, in such a way as to absorb and anomalous overpressures generated, in operation, downstream of the pump.

4 Claims, 3 Drawing Sheets

RECIPROCATING ELECTROMAGNETIC MICRO-PUMP, PARTICULARLY FOR SMALL ELECTRICAL APPLIANCES

FIELD OF THE INVENTION

The present invention generally relates to hydraulic pumps, and more specifically it pertains to a reciprocating electromagnetic micro-pump to be used particularly, but not exclusively, in small electrical appliances.

STATE OF THE PRIOR ART

Such micro-pumps traditional comprise a hollow body having an inlet for the water and in whose cavity is alternatively movable a core made of ferromagnetic material co-operating with an electrical excitation winding which surrounds the hollow body. The core bears a tubular piston, with associated intake valve, designed to slide in sealed fashion within a pumping chamber communicating with an outlet by means of a one-way delivery valve.

In the application to small electrical appliances, micro-pumps of the kind defined above feed the water from a tank to the dispensing member of the apparatus: in particular, in the case of steam electrical appliances, to a boiler or to an instantaneous steam generator. Current standards for such applications impose the presence, on the delivery line of the micro-pump, of safety devices constituted by maximum pressure valves or the like, able to act if an anomalous over-pressure is produced downstream of the pump. The presence of such safety system entails production and assembly expenses with clearly impact on the final cost of the electrical appliance whereto the micro-pump is applied with, for obvious market-related reasons, should instead be as low as possible.

SUMMARY OF THE INVENTION

The object of the present invention is to overcome the aforesaid drawback, and more in particular to provide a reciprocating electromagnetic micro-pump whose application, in particular to small electrical appliances, removes the need for additional safety devices against anomalous overpressures downstream of its output.

According to the invention, said object is achieved thanks to the fact that the pumping chamber of the micro-pump is defined by a tubular element that is axially movable, against the action of elastic contrast means, between an advanced position of normal operation of the pump and a retracted position in which said outlet is placed in communication with a volume inside the pump, in turn communicating with the inlet fitting for the absorption of any overpressures.

Advantageously, said volume comprises the cavity of said hollow body.

Thanks to the solution idea, any anomalous overpressure downstream of the pump can be absorbed and disposed by the pump itself, thanks to the backward motion of the tubular element which defines the pumping chamber and to the consequent discharge of the overpressure from the area situated downstream of the one-way delivery vale in the inlet fitting, and hence to the water tank connected thereto.

Conventionally, the one-way delivery valve comprises a shutter co-operating, under the action of an elastic thrusting member, with an annular valve seat, in such a way that the shutter opens during the delivery cycles of the piston, closing during the cycles in which water is drawn in from the inlet fitting. According to a preferred embodiment of the invention, said annular seat of the one-way delivery valve is movable with the aforesaid tubular element which defines the pumping chamber, and it is advantageously formed by the end of said tubular element that faces the outlet fitting.

BRIEF DESCRIPTION OF THE DRAWINGS

The invention shall now be described in detail with reference to the accompanying drawings, provided purely by way of non limiting example, in which.

DETAILED DESCRIPTION OF THE INVENTION

Figure 3:
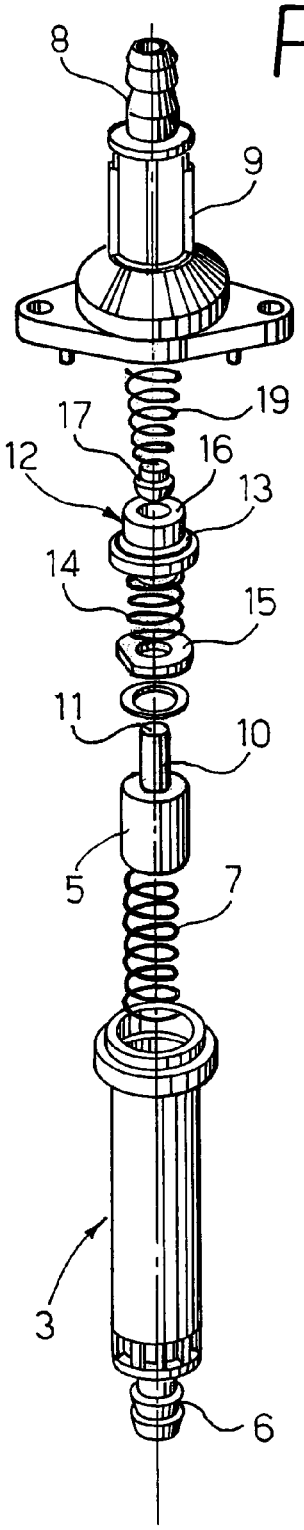
FIG. 3 is an exploded perspective view of a part of the components of the micro-pump.
Figure 1:
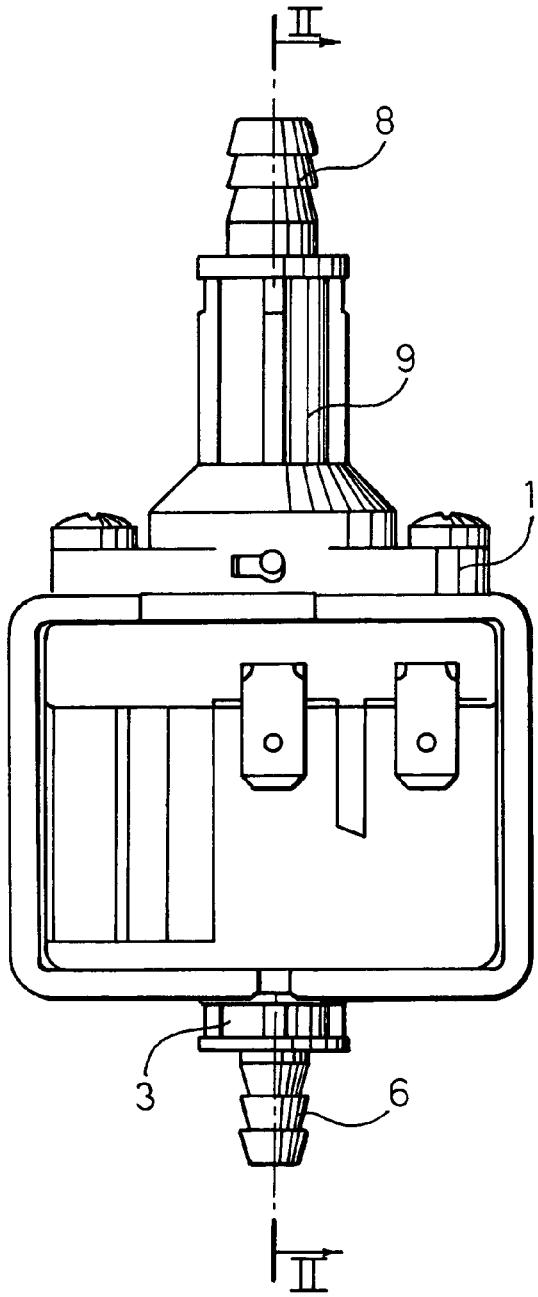
FIG. 1 is a schematic elevation view of a reciprocating electromagnetic micro-pump according to the invention.

Referring to the drawings, the reciprocating electromagnetic micro-pump according to the invention essentially comprises a container made of electrically insulating material 1 containing an annular electrical winding 2 which coaxially surrounds a hollow body 3 within whose cavity 4 is alternatively movable, with radial play, a core of ferromagnetic material 5. The hollow body 3 is formed at an end with a tubular inlet fitting 6 to be connected with a water tank, and between said fitting 6 and the core 5 is interposed a helical compression spring 7 which tends to press said core 5 towards a tubular outlet fitting 8 borne by a hollow member 9 fastened coaxially in sealed fashion to the hollow body 3, at the opposite side from the inlet fitting 6.

The core 5, in turn, is hollow, and coaxially bears a hollow piston 10 provided at its free end, in conventional fashion, with an intake valve 11.

The piston 10 is able to slide in sealed fashion within a pumping chamber defined by a tubular element 12, coaxial with the hollow body 3 and with the hollow member 9 and normally placed in sealed contact therewith by means of an annular gasket 13.

Figure 2A:
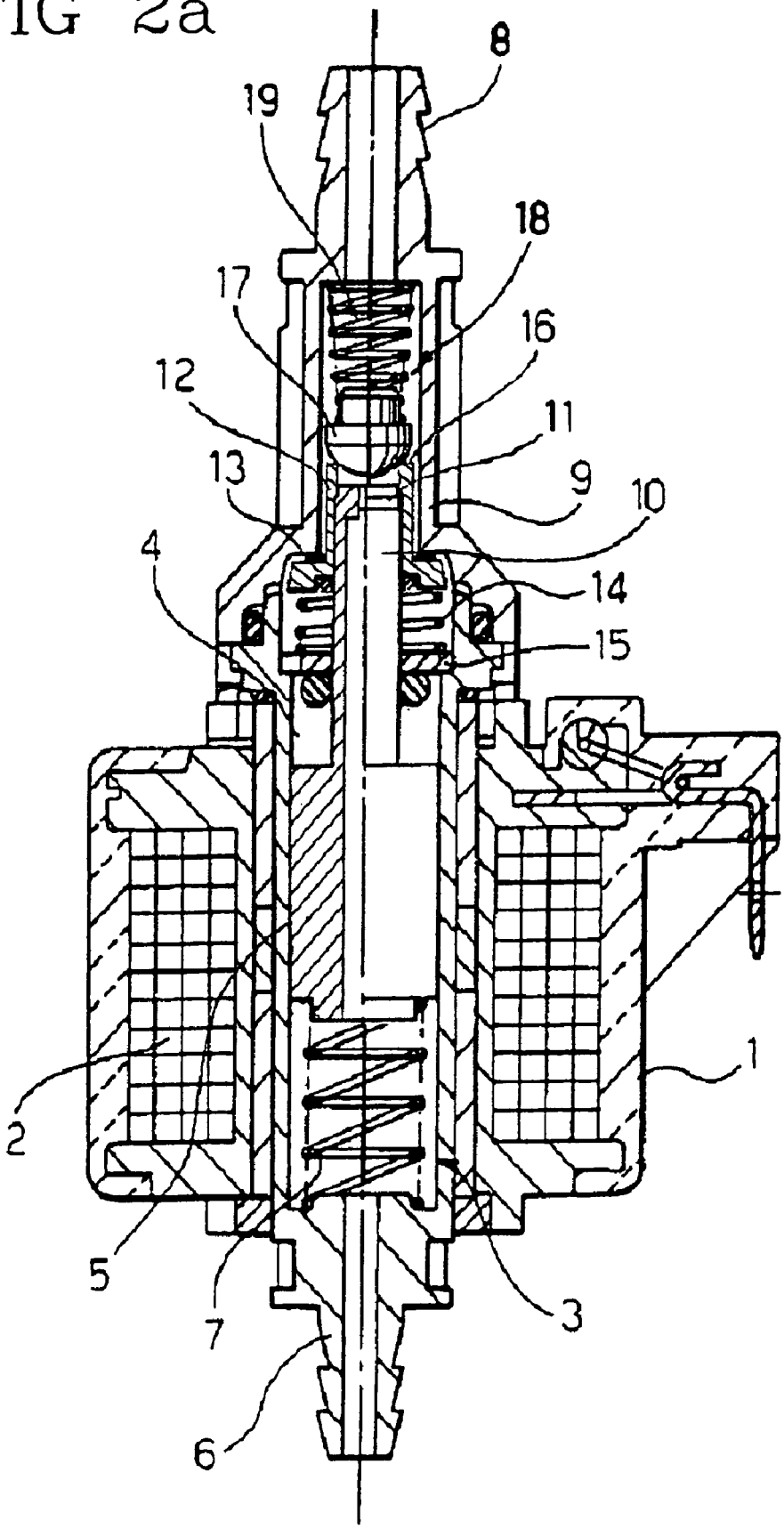
FIG. 2*a* is a longitudinal section view according to the line II-II of FIG. 1 in a first operating position.
Figure 2B:
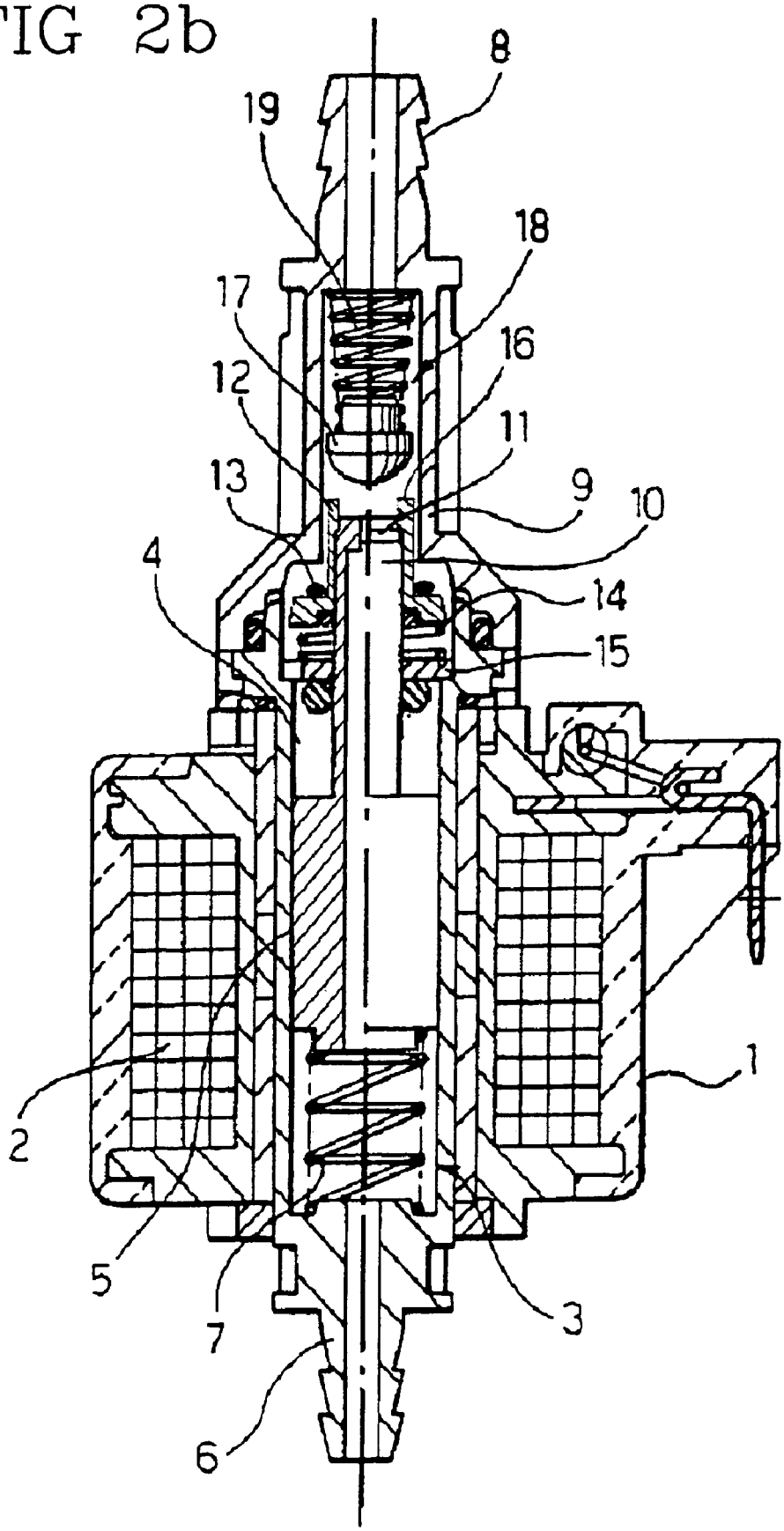
FIG. 2*b* is a longitudinal section view according to the line II-II of FIG. 1 in a second operating position.

According to the fundamental characteristic of the invention, the tubular element 12 which defines the pumping chamber is axially movable within the hollow member 9 between an advanced position of normal operation, shown in FIG. 2 and in which it is as stated in sealed contact with the inner wall of the hollow member 9, and a lowered position in which it allows communication between the area of the hollow member 9 communicating with the outlet fitting 8 and the cavity 4 of the hollow body 3, which in turn is in communication with the inlet fitting 6 connected with the water tank. The tubular element 12 is normally maintained in the raised position by the action of a helical compression spring 14, having a predetermined load, which reacts against a cut or holed washer 15 housed coaxially in the hollow body 3 and traversed by the piston 10.

The end of the tubular element 12 oriented towards the outlet fitting 8 defines an annular valve seat 16 for a shutter 17 of a one-way delivery valve 18. The shutter 17 is normally pressed in sealed contact against the seat 16 by means of an elastic thrust member 19 (for example, a helical compression spring) reacting against the outlet fitting 8.

The normal operation of the pump thus described is conventional: the excitation of the electrical winding 2 and the action of the spring 7 produce the reciprocating displacement of the core 5 within the cavity 4 of the hollow body 3 and consequently of the piston 10 within the pumping chamber defined by the tubular element 12. In this way, the water taken in through the inlet fitting 6 is cyclically pumped under pressure towards the outlet fitting 8, by effect of the cyclical opening of the delivery valve 18.

If an anomalous overpressure, exceeding the axial spring-load of the spring 14, is produced downstream of the outlet fitting 8, then the tubular element 12 moves from the advanced position towards the rear position, against the action of the spring 14, thereby placing in communication the outlet fitting 8 with the cavity 4 of the hollow body 3 and hence with the inlet fitting 6, in practice bypassing the one-way delivery valve 18. Any overpressure can thus be discharged and be absorbed through the venting volume defined by the cavity 4 towards the inlet fitting 6 and hence within the water tank connected thereto. To this also contributes, in part, the space made available—as a consequence of the rearward motion of the tubular element 12—within the hollow member 9 between the one-way delivery valve 18 and the outlet fitting 8.

This arrangement makes it unnecessary to provide auxiliary devices for venting the pressure in the connecting line between the pump and the apparatus whereto it is applied.

Naturally, the construction details and the embodiments may be varied widely from what is described and illustrated herein, without thereby departing from the scope of the present invention as defined in the claims that follow.

What is claimed is:

1. A reciprocating electromagnetic micro-pump, particularly for small electrical appliances, comprising a hollow body defining a cavity and having a water inlet fitting, an electrical excitation winding surrounding said hollow body, a core of ferromagnetic material movable in reciprocating fashion in said cavity and co-operating with said electrical excitation winding, a tubular element defining a pumping chamber, an outlet fitting, and a one-way delivery valve connecting said a pumping chamber to said outlet fitting, a tubular piston with associated intake valve, extending from one end of said core, said tubular piston being sealingly slidable within said pumping chamber, and the tubular element being axially movable, against the action of a compression spring, between an advanced position of normal operation of the pump and a retracted position in which said outlet fitting is placed in communication with said cavity of the pump in turn communicating with said inlet fitting, for the absorption of any overpressures.

2. Reciprocating electromagnetic micro-pump as claimed in claim 1, wherein an inner volume comprises said cavity of said hollow body.

3. Reciprocating electromagnetic micro-pump as claimed in claim 1, in which said one-way delivery valve comprises an obturator member co-operating, under the action of an elastic thrust member, with an annular valve seat, wherein said annular valve seat is movable with said tubular element defining said pumping chamber.

4. Reciprocating electromagnetic micro-pump as claimed in claim 3, wherein said annular valve seat is formed by one end of said tubular element oriented towards said outlet fitting.

* * * * *